US005544577A

United States Patent [19]

Kato

[11] Patent Number: 5,544,577

[45] Date of Patent: Aug. 13, 1996

[54] MECHANICAL PRESSING MACHINE WITH MEANS FOR CANCELLING LOAD FLUCTUATION TORQUE

[75] Inventor: Heizaburo Kato, Shizuoka-ken, Japan

[73] Assignee: Sankyo Seisakusho Co., Tokyo, Japan

[21] Appl. No.: 328,908

[22] Filed: Oct. 25, 1994

[30] Foreign Application Priority Data

Oct. 26, 1993 [JP] Japan ..... 5-267290

[51] Int. Cl.[6] ..... B30B 1/06

[52] U.S. Cl. ..... 100/35; 83/615; 100/282

[58] Field of Search ..... 100/214, 259, 100/280, 292, 282, 35; 72/429, 451, 452; 74/49, 55, 589–591, 603, 604; 83/615, 628

[56] References Cited

U.S. PATENT DOCUMENTS 2,857,157 10/1958 Bonquet ..... 100/259
4,638,731 1/1987 Kato ..... 100/282

FOREIGN PATENT DOCUMENTS 54-89683 6/1979 Japan .
1402201 8/1975 United Kingdom ..... 72/452

*Primary Examiner*—Stephen F. Gerrity
*Attorney, Agent, or Firm*—Harness, Dickey & Pierce, P.L.C.

[57] ABSTRACT

In a mechanical pressing machine, a torque compensation plate cam is mounted on one end of a crankshaft, and a cam follower mounted on a distal end of a piston rod of a resilient force-producing device is held in pressing contact with the torque compensation plate cam so as to cancel a load fluctuation produced on the crankshaft. The resilient force-producing device employs a compression coil spring or an air spring. The crankshaft may be of the dual type, in which case a slider is supported by two connecting rods. With this construction, a periodic inertial load fluctuation, repeatedly produced for every revolution during the operation of the mechanical press, is compensated for by the system for reserving energy, and hence is cancelled, thereby balancing the energy, so that variations in rotation of the crankshaft are eliminated, thereby reducing vibrations and noises.

22 Claims, 8 Drawing Sheets

MECHANICAL PRESSING MACHINE WITH MEANS FOR CANCELLING LOAD FLUCTUATION TORQUE

BACKGROUND OF THE INVENTION

This invention relates to a mechanical pressing machine of the type in which a slider is reciprocally moved linearly relative to a frame through a crankshaft.

In a mechanical pressing machine employing a crankshaft, a connecting rod is connected at its one end to an eccentric portion of the continuously rotating crankshaft, and a slider is connected to the other end of the connecting rod, thereby converting a rotational motion of the crankshaft into a reciprocal linear motion of the slider. When imparting the reciprocal motion to the slider, an inertia load of the slider, an unbalanced load, a pressing load and so on give fluctuating load torques to the crankshaft through the connecting rod. When these fluctuating load torques increase, the crankshaft may fail to rotate only by a drive torque of a motor. To avoid this, a flywheel has heretofore been attached to one end of the crankshaft. An abruptly-fluctuating load torque of the crankshaft is absorbed by an inertia force of the flywheel, so that the maximum value of the input torque is alleviated. This enables the machine to be operated by an output torque of the relatively small motor.

Recently, because of an increasing demand for a small-size, high-density design of electronic components and also for a clean environment, it has been desired to provide a high-performance mechanical pressing machine less noisy and highly precise. Reviewing pressing machines from this point of view, it will be appreciated that the currently-available mechanical pressing machines are so designed as to absorb all of the fluctuating loads by means of a flywheel. It is very rational and most desirable from the viewpoint of a mechanism to absorb an excessively large load fluctuation, produced instantaneously as in a pressing operation, by the inertia force of a large flywheel; however, although a constant load fluctuation, produced when imparting a reciprocal motion to the slider, can be ignored during a low-speed operation, its energy exceeds the energy of the pressing operation during a high-speed operation, so that the speed of rotation of the crankshaft attached to the flywheel increases and decreases, and hence varies periodically for every revolution. It is known that such variations in rotation of the input drive system cause vibrations of the press and noises, and also adversely affect the durability of a clutch and a brake.

SUMMARY OF THE INVENTION

With the above problems of the prior art in view, it is an object of this invention to provide a mechanical pressing machine in which a periodic inertial load fluctuation, repeatedly produced for every revolution during the operation of a mechanical press, is compensated for by another system for reserving energy, and hence is cancelled, thereby balancing the energy so that variations in rotation of a crankshaft can be eliminated, thereby reducing vibrations and noises.

According to the present invention, there is provided a mechanical pressing machine comprising a crankshaft having a flywheel mounted on one end thereof; a motor operatively connected to the crankshaft for transmitting a rotational force of the motor to the crankshaft; a slider; a connecting rod connected between the crankshaft and the slider for converting a rotational motion of the crankshaft into a reciprocal linear motion of the slider; a torque compensation plate cam mounted on the other end of the crankshaft for cancelling a load fluctuating torque produced on the crankshaft; a resilient force-producing device including a piston rod; and a cam follower mounted on a distal end of the piston rod and pressed against the torque compensation plate cam.

The resilient force-producing device employs either a compression coil spring mounted within a cylinder slidably receiving the piston rod, or gas sealed in the cylinder. The crankshaft may be of the dual type, in which case the slider is supported by two connecting rods.

With the above construction of the present invention, a load fluctuating torque produced on the crankshaft is cancelled by the torque compensation plate cam, and therefore variations or irregularities in rotation of the crankshaft are eliminated, so that vibrations and noises can be reduced.

DESCRIPTION OF THE PREFERRED EMBODIMENTS

Figure 1:
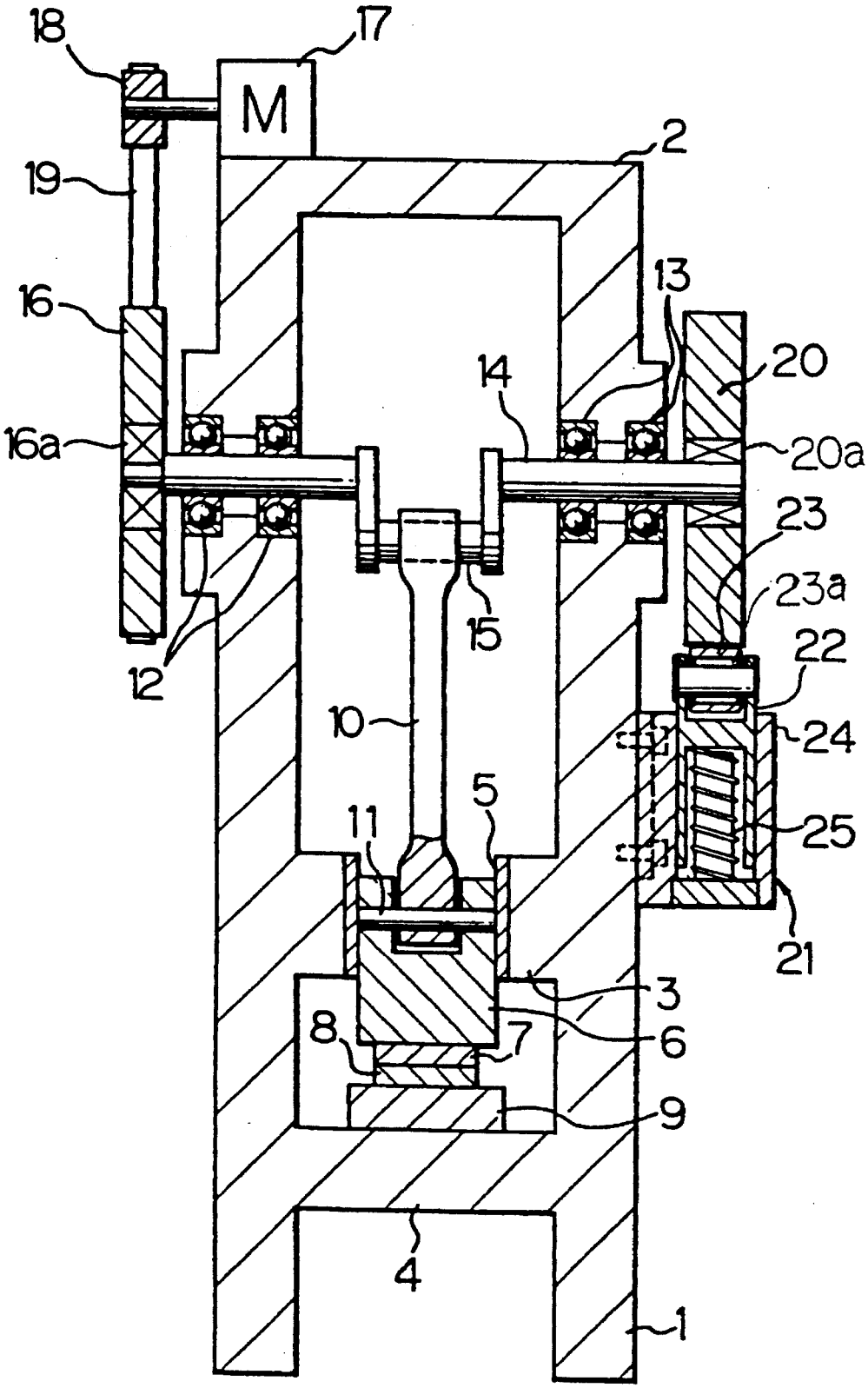
FIG. 1 is a schematic cross-sectional view of one preferred embodiment of a mechanical pressing machine of the present invention as viewed from a front side thereof.
Figure 2:
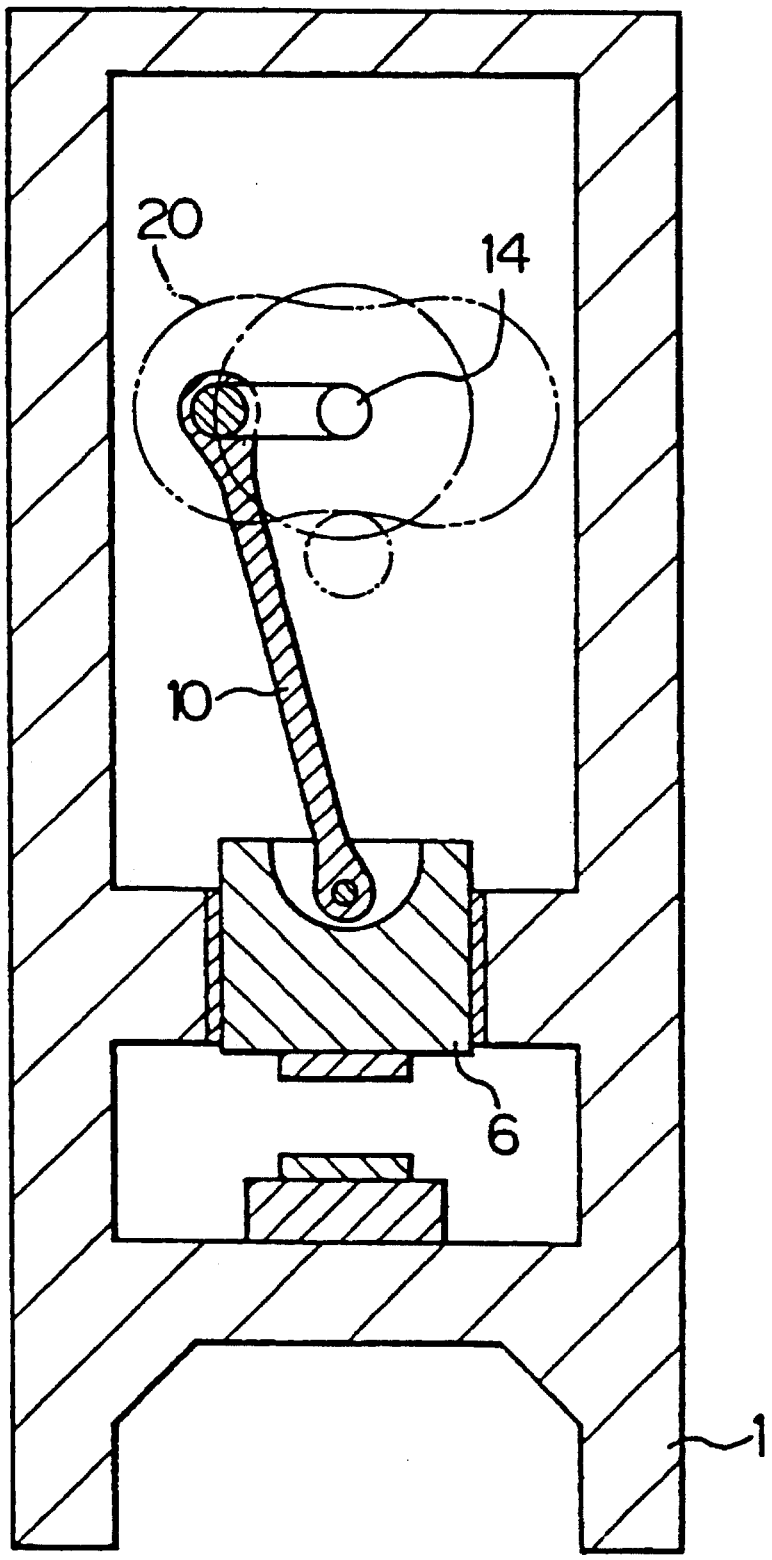
FIG. 2 is a schematic cross-sectional view of the pressing machine as viewed from a left side thereof.
Figure 3:
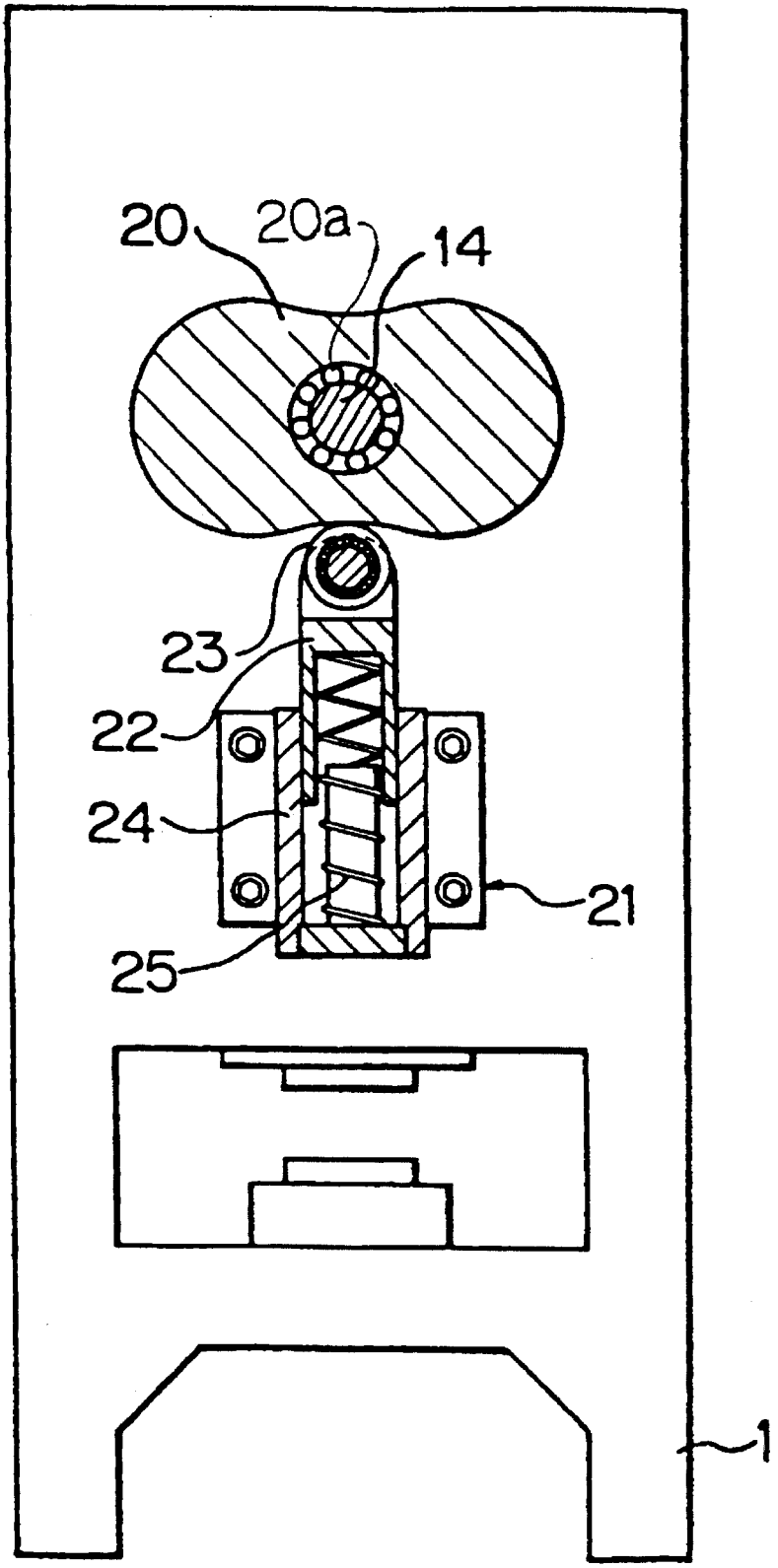
FIG. 3 is a schematic cross-sectional view of the pressing machine as viewed from a right side thereof.

FIG. 1 is a schematic cross-sectional view of one preferred embodiment of a mechanical pressing machine of the present invention as viewed from a front side thereof, FIG. 2 is a schematic cross-sectional view of the pressing machine as viewed from a left side thereof, and FIG. 3 is a schematic cross-sectional view of the pressing machine as viewed from a right side thereof. A frame 1 is of a box-shape, and includes an upper support portion 2, an intermediate support portion 3, and a lower support portion 4. A slider 6 is mounted on the intermediate support portion 3 of the frame 1 through a bearing 5 for sliding movement in a vertical direction. An upper die 7 is mounted on a lower end of the slider 6, and a lower die 8 is mounted on the lower support portion 4 of the frame 1 through a bolster 9.

A lower end of a connecting rod 10 is rotatably connected to an upper portion of the slider 6 by a connecting pin 11. An upper end of the connecting rod 10 is rotatably connected to a crankpin 15 eccentrically mounted on a central portion of a crankshaft 14 rotatably-mounted on the frame 1 through bearings 12 and 13. A flywheel 16 is fixedly mounted on one end of the crankshaft 14, and this flywheel 16 is driven for rotation through a belt 19 by a pulley 18 fixedly mounted on a rotation shaft of a motor 17 mounted on the upper support portion 2 of the frame 1. A torque compensation plate cam 20 of a generally cocoon-shape is fixedly mounted on the other end of the crankshaft 14, and a cam follower 23 is rotatably mounted on a distal end of a piston rod 22 of a resilient force-producing device 21 fixedly mounted on a back plate of the frame 1. The cam follower 23 is held in pressing contact with the torque compensation plate cam 20. The resilient force-producing device 21 has a compression coil spring 25 mounted within a cylinder 24 slidably receiving the piston rod 22 therein, and the cam follower 23 is urged by the compression coil spring 25 into contact with a peripheral edge of the torque compensation plate cam 20. In the drawings, reference numerals 16*a* and 20*a* denote shaft fastening elements, respectively, and reference numeral 23*a* denotes a needle.

The operation of the above mechanical pressing machine will now be described. When the motor 17 rotates, and transmits its rotational force to the flywheel 16 via the pulley 18 and the belt 19 to rotate the crankshaft 14, the slider 6 is reciprocally moved vertically through the connecting rod 10, and a workpiece is worked between the upper and lower dies 7 and 8 mounted respectively on the slider 6 and the lower support portion 4 of the frame 1. On the other hand, the torque compensation plate cam 20, fixedly mounted on the other end of the crankshaft 14, acts to cancel a load fluctuating torque produced on the crankshaft 14 during the working of the workpiece by the reciprocal movement of the slider 6.

An inertia torque Ts, acting on the continuously-rotating crankshaft 14 during the reciprocal movement of the slider 6, is proportional to the product of the acceleration A and velocity V of the slider 6 as follows where th represents the time required for a stroke of the slider 6.

$$Ts=I(Th^2/th^2/\theta h)A\cdot V$$

where I represents an inertia moment (kgf·m/s$^2$) of the slider, Th represents displacement (rad) of the slider, th represents time (s) required for rotation for Th, and θh represents an input shaft displacement (rad).

Figure 4:
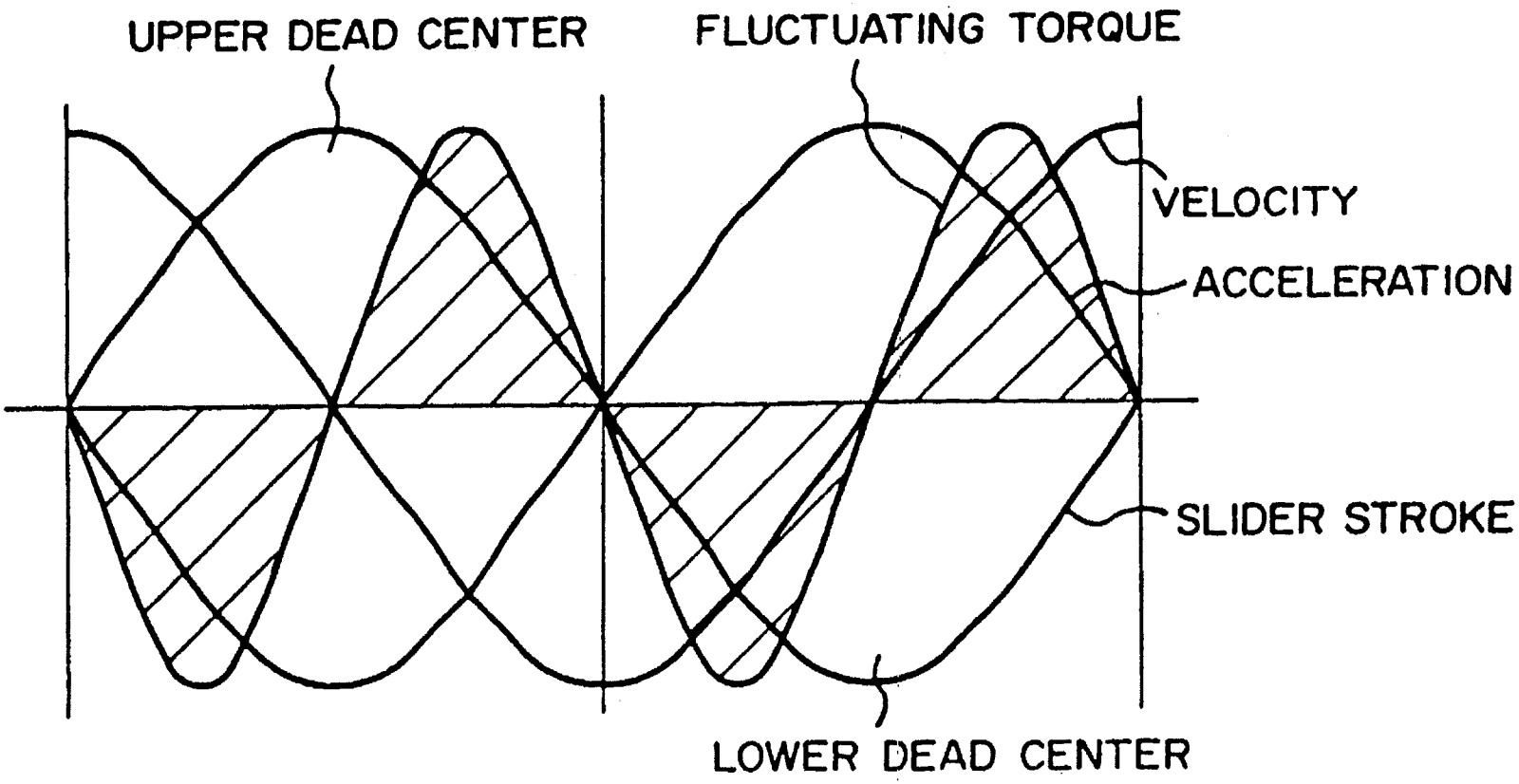
FIG. 4 is a graph showing the relation of a slider stroke with an acceleration and a velocity in the pressing machine of FIG. 1.

As will be appreciated from the above formula, Ts is proportional to A·V, and as indicated by hatching in FIG. 4, a negative torque is produced in the first half up to a lower dead center of the slider stroke S. A positive torque is produced in the second half from the lower dead center. With respect to an upper dead center, similarly, a negative torque is produced in the first half up to the upper dead center, and a positive torque is produced in the second half from the upper dead center. In order to cancel these torques, opposite torques relative to these torques are produced by the torque compensation plate cam 20 and the resilient force-producing device 21 so that the torque (energy) can be balanced over an entire range of one revolution of the crankshaft 14.

Due to a spring constant F of the compression coil spring 25 of the resilient force-producing device 21, the torque Tk acting on the crankshaft 14 is expressed by the following formula where y represents displacement of the torque compensation plate cam 20:

$$Tk=Fdy/d\theta=Fyth/\theta h$$

By solving the above formulas in such a manner that the sum of the torque Ts and the torque Tk becomes always zero (0), the contour of the torque compensation plate cam 20 can be found, and the load fluctuation of the crankshaft 14 is cancelled as described above, and therefore vibrations and noises are reduced, and the efficiency of the operation is improved, and an energy-saving effect can be expected.

Figure 5:
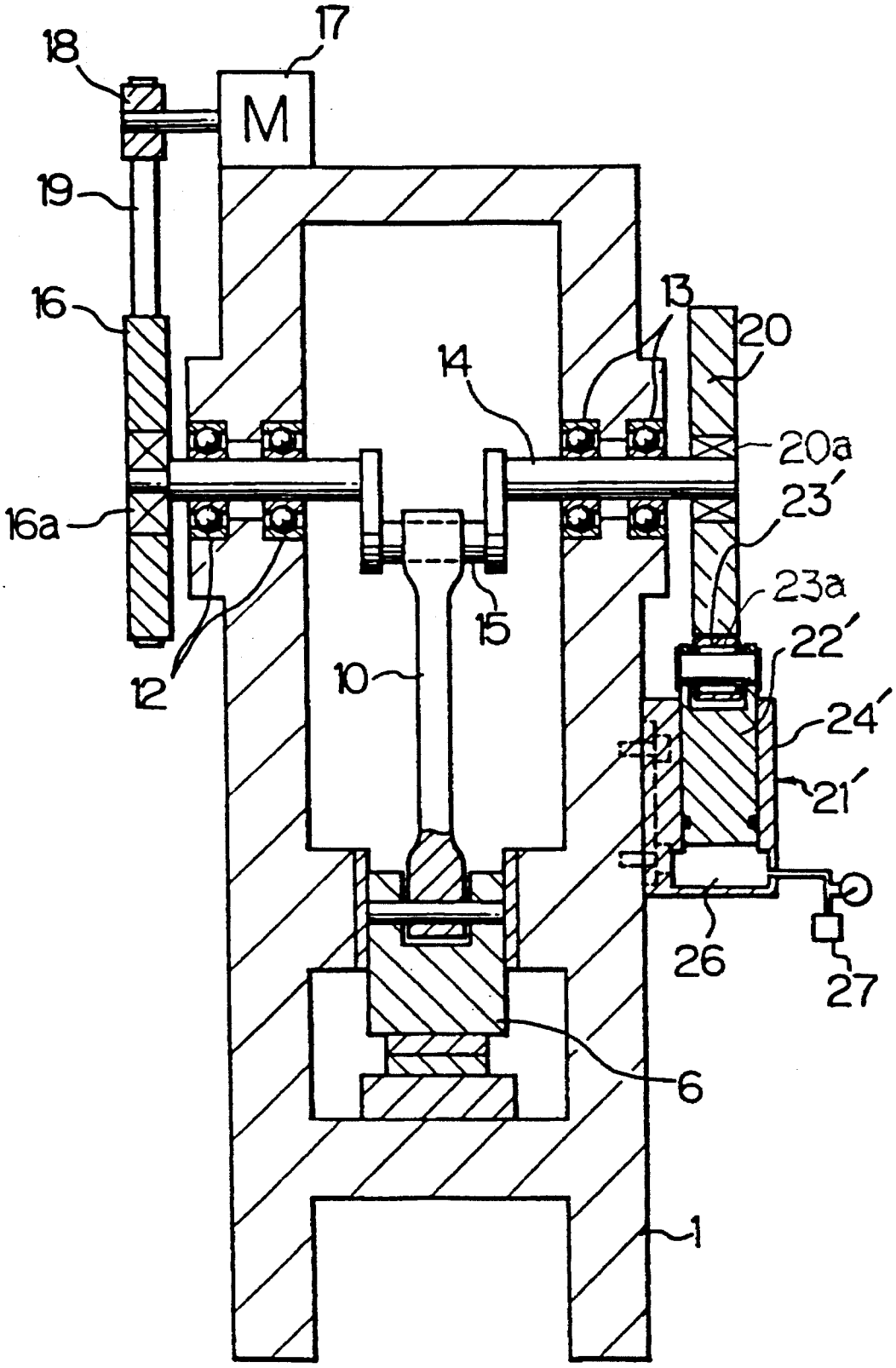
FIG. 5 is a schematic cross-sectional view of another preferred embodiment of a mechanical pressing machine of the invention as viewed from a front side thereof.
Figure 6:
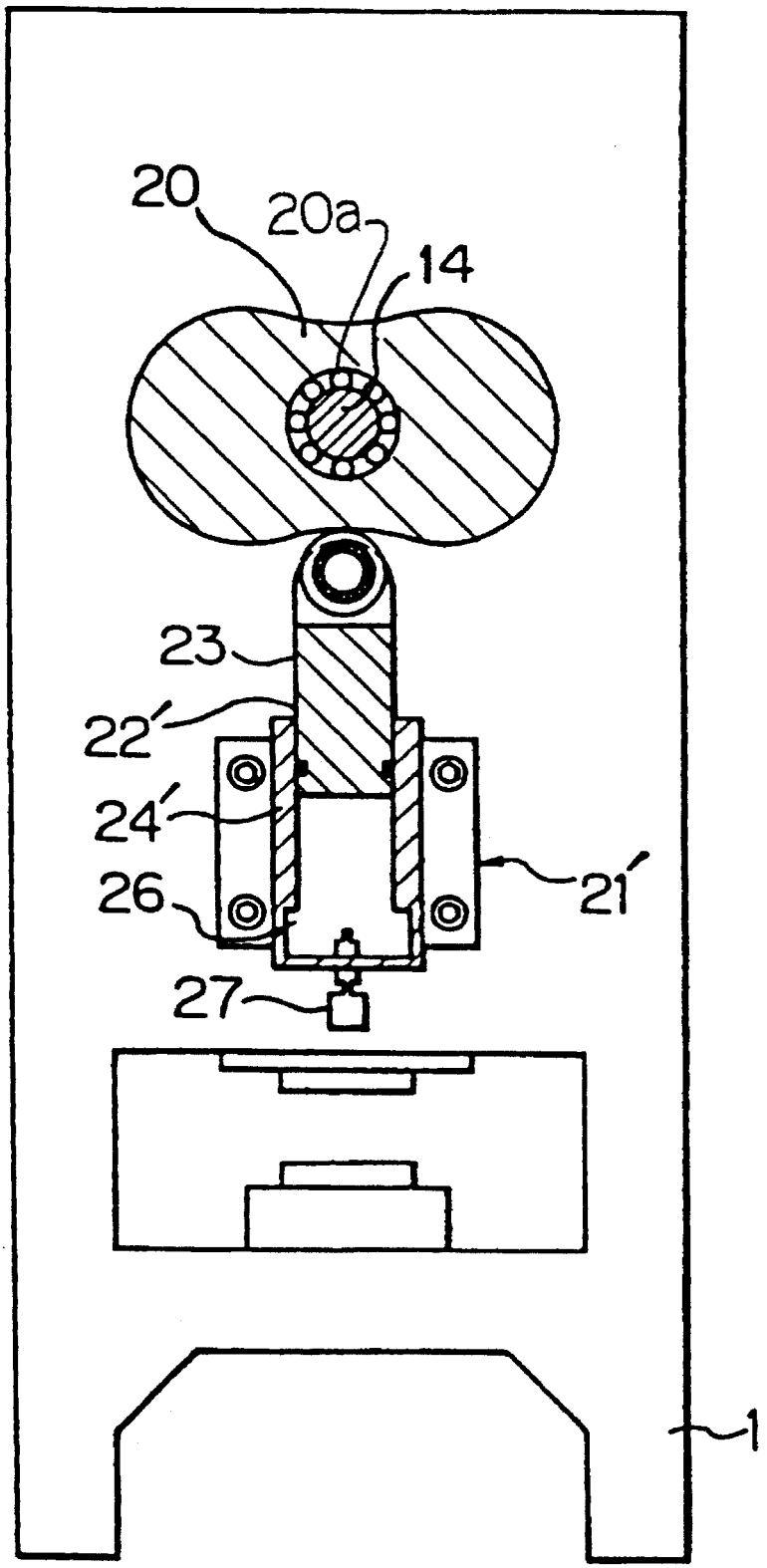
FIG. 6 is a schematic cross-sectional view of the mechanical pressing machine of FIG. 5 as viewed from a right side thereof.

FIG. 5 is a schematic cross-sectional view of another preferred embodiment of a mechanical pressing machine of the present invention as viewed from a front side thereof, and FIG. 6 is a schematic cross-sectional view of this pressing machine as viewed from a right side thereof. A left side-elevational view of this pressing machine is similar to that of FIG. 2. Although the resilient force-producing device 21 in the above pressing machine of the first embodiment employs the compression coil spring 25, an air spring is used in this embodiment. The other construction is the same as that of the first embodiment, and therefore those portions of this embodiment identical respectively to those of the first embodiment are designated by identical reference numerals, respectively, and explanation thereof will be omitted. Referring to FIGS. 5 and 6, in a resilient force-producing device 21', a cam follower 23' is rotatably mounted on a distal end of a piston rod 22' and the air 26 is sealed in a cylinder 24' slidably receiving the piston rod 22' therein. The sealed air 26 may be replaced by any other suitable gas. A pressure regulator 27 for adjusting the air pressure within the cylinder 24' is connected to the cylinder 24'.

In this embodiment, since the air spring is used as the resilient force-producing device, there is provided an advantage that by adjusting the air pressure within the cylinder 24' by the pressure regulator 27, a fine adjustment for torque compensation purposes can be easily effected.

Figure 7:
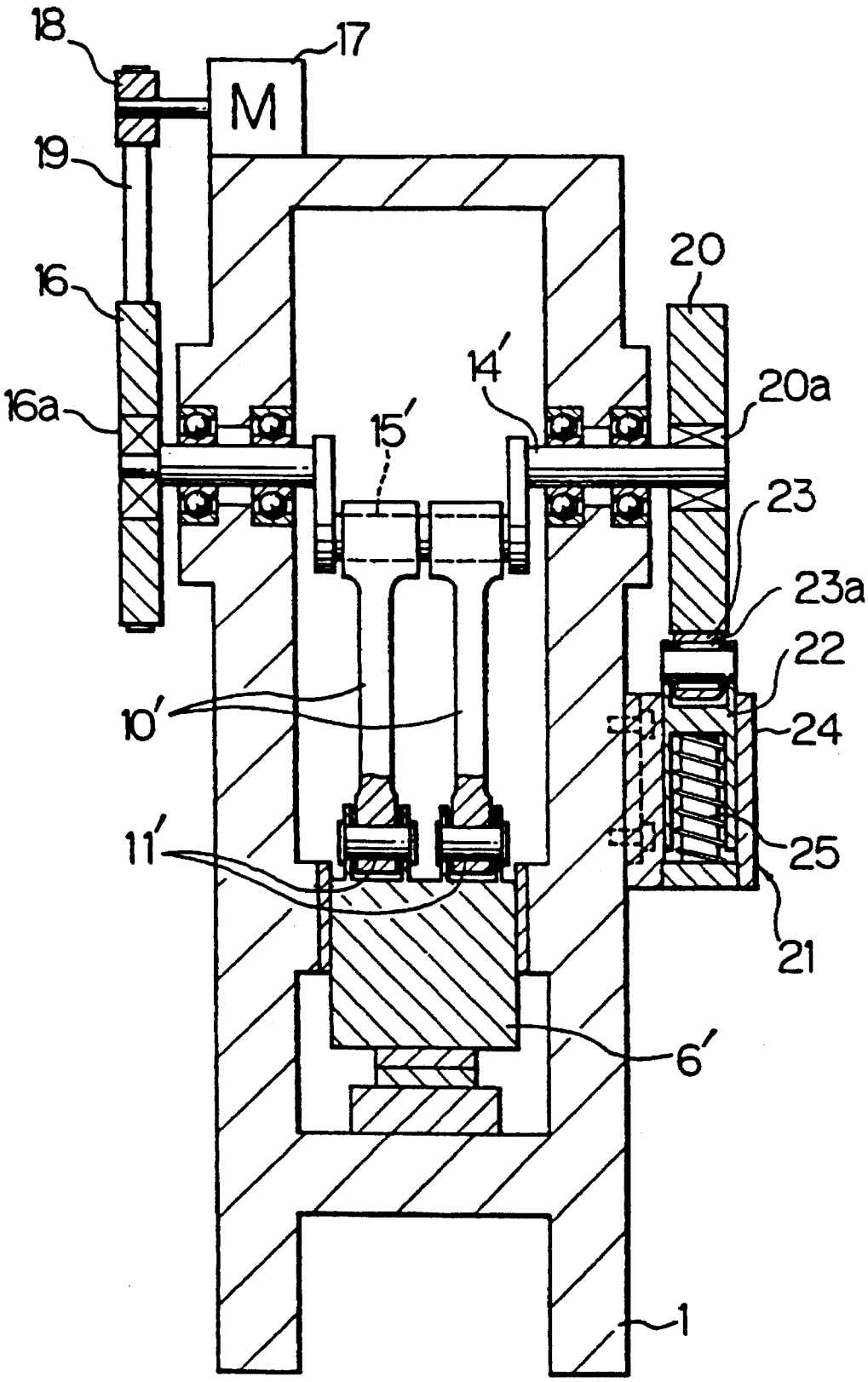
FIG. 7 is a schematic cross-sectional view of a further preferred embodiment of a mechanical pressing machine of the invention as viewed from a front side thereof.

FIG. 7 shows another modified form of the invention which differs from the pressing machine of FIGS. 1 to 3 in that a dual-type crankshaft 14' is used. Two connecting rods 10' are rotatably connected at their upper ends to a crankpin 15' of the dual-type crankshaft 14', and the lower end of each of the two connecting rods 10' is rotatably connected to an upper end of a slider 6' by a connecting pin 11'.

In this embodiment, since the points of connection of the connecting rods 10' to the slider 6' are two, there is provided an advantage that even if the center of gravity of the die attached to the pressing machine, as well as the load provided during the pressing operation, is not located at the center of the pressing machine, the die is effectively prevented from being tilted by an unbalanced load.

Figure 8:
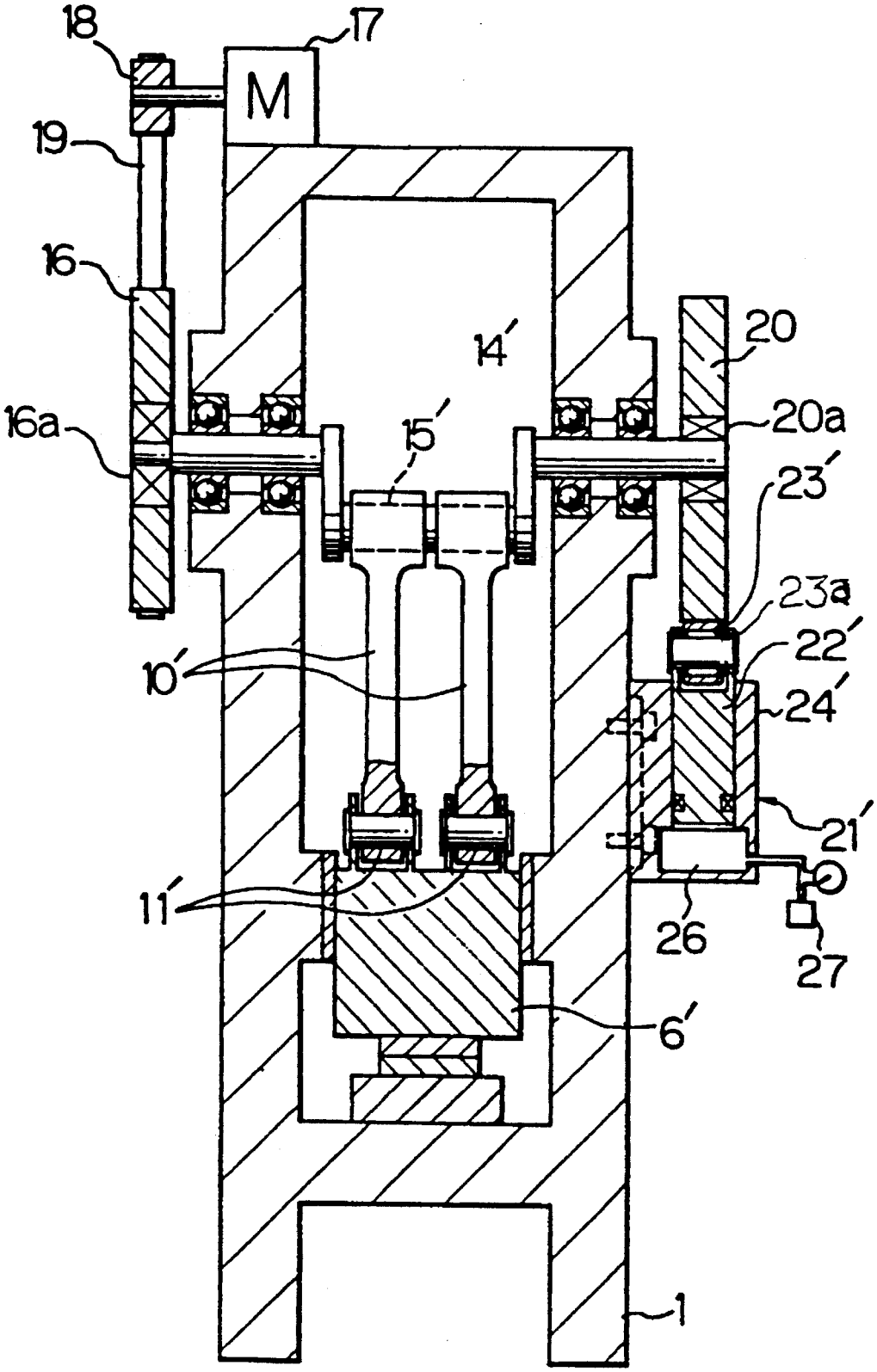
FIG. 8 is a schematic cross-sectional view of a still further preferred embodiment of a mechanical pressing machine of the invention as viewed from a front side thereof.

FIG. 8 shows a further modified form of the invention which differs from the pressing machine of FIGS. 5 and 6 in that a dual-type crankshaft 14' is used as in the pressing machine of FIG. 7. In this embodiment, also, since the points of connection of connecting rods 10' to a slider 6' are two, there is provided an advantage that even if the center of gravity of the die attached to the pressing machine, as well as the load provided during the pressing operation, is not located at the center of the pressing machine, the die is effectively prevented from being tilted by an unbalanced load.

As described above, in the present invention, the torque compensation plate cam is mounted on one end of the crankshaft, and the cam follower mounted on the distal end of the piston rod of the resilient force-producing device is pressed against the torque compensation plate cam so as to cancel the load fluctuating torque produced on the crankshaft. Therefore, variations or irregularities in rotation of the crankshaft are eliminated to reduce vibrations and noises, and the efficiency of the operation is improved, and the energy-saving effect can be expected.

What is claimed:

1. In a mechanical pressing machine comprising a crankshaft having a flywheel mounted on one end thereof; a motor operatively connected to said crankshaft for transmitting a rotational force of said motor to said crankshaft; a slider having a linear reciprocal stroke; and a connecting rod connected between said crankshaft and said slider for converting a rotational motion of said crankshaft into a reciprocal linear motion of said slider;

the improvement comprising a generally cocoon-shape torque compensation plate cam mounted on the other end of said crankshaft for cancelling a load fluctuating torque produced on said crankshaft during the entire rotation of the crankshaft; a resilient force-producing device including a piston rod; a cam follower mounted on a distal end of said piston rod and pressed against said torque compensation plate cam for cancelling the load fluctuation torque produced during the entire rotation of the crankshaft.

2. A mechanical pressing machine according to claim 1, in which said resilient force-producing device comprises a cylinder slidably receiving said piston rod therein, and a compression coil spring mounted within said cylinder to urge said piston rod.

3. A mechanical pressing machine according to claim 1, in which said resilient force-producing device comprises a cylinder slidably receiving said piston rod therein, and gas being sealed within said cylinder to urge said piston rod.

4. A mechanical pressing machine according to claim 2, in which said crankshaft is of the dual type, and two said connecting rods are connected to said slider.

5. A mechanical pressing machine according to claim 3, in which said crankshaft is of the dual type, and two said connecting rods are connected to said slider.

6. The mechanical pressing machine according to claim 1, wherein a negative inertia torque is produced when the slider moves from the center of its reciprocal stroke to the ends of its stroke and a positive inertia torque is produced when said slider moves from the ends of its stroke to the center of its reciprocal stroke.

7. The mechanical pressing machine according to claim 1, wherein the inertia torque acts on said crankshaft during the reciprocal linear stroke motion of said slider, and an opposite torque is produced by the torque compensation plate cam in conjunction with the resilient force-producing device; the caming contour of the torque compensation plate cam shaped so that the sum of the inertia torque and the opposite torque is zero and the load fluctuation torque of the crankshaft produced during the rotation of the crankshaft is cancelled.

8. A mechanical pressing machine comprising a crankshaft having a flywheel mounted on one end thereof; a motor operatively connected to said crankshaft for transmitting a rotational force of said motor to said crankshaft; a slider having a linear reciprocal stroke; and a connecting rod connected between said crankshaft and said slider for converting a rotational motion of said crankshaft into a reciprocal linear motion of said slider; a torque compensation plate cam mounted on the other end of said crankshaft for cancelling load fluctuating torque produced on said crankshaft; a resilient force-producing device including a piston rod; a cam follower mounted on a distal end of said piston rod and pressed against said torque compensation plate cam, the torque compensation plate cam having a caming contour so that said torque compensating plate cam working in conjunction with the resilient force-producing device cancels the load fluctuating torque produced during the entire rotation of the crankshaft.

9. The mechanical pressing machine according to claim 8, in which said resilient force-producing device comprises a cylinder slidably receiving said piston rod therein, and a compression coil spring mounted within said cylinder to urge said piston rod.

10. The mechanical pressing machine according to claim 9, in which said crankshaft is of the dual type, and two connecting rods are connected to said slider.

11. The mechanical pressing machine according to claim 8, in which said resilient force-producing device comprises a cylinder slidably receiving said piston rod therein, and gas being sealed within said cylinder to urge said piston rod.

12. The mechanical pressing machine according to claim 11, in which said crankshaft is of the dual type, and two connecting rods are connected to said slider.

13. The mechanical pressing machine according to claim 8, wherein a negative inertia torque is produced when the slider moves from the center of its reciprocal stroke to the ends of its stroke and a positive inertia torque is produced when said slider moves from the ends of its stroke to the center of its reciprocal stroke.

14. The mechanical pressing machine according to claim 8, wherein the caming contour of the torque compensating plate cam is generally cocoon-shape.

15. The mechanical pressing machine according to claim 8, wherein the inertia torque acts on said crankshaft during the reciprocal linear stroke motion of said slider, and an opposite torque is produced by the torque compensation plate cam in conjunction with the resilient force-producing device; the caming contour of the torque compensation plate cam shaped so that the sum of the inertia torque and the opposite torque is zero and the load fluctuation torque of the crankshaft produced during the rotation of the crankshaft is cancelled.

16. A method of cancelling the load fluctuation of a mechanical pressing machine comprising a crankshaft having a flywheel mounted on one end thereof; a motor operatively connected to said crankshaft for transmitting a rotational force of said motor to said crankshaft; a slider having a linear reciprocal stroke; and a connecting rod connected between said crankshaft and said slider for converting a rotational motion of said crankshaft into a reciprocal linear motion of said slider; the method comprising mounting a torque compensation plate cam on the other end of said crankshaft for entirely cancelling the load fluctuating torque produced on said crankshaft; a resilient force-producing device including a piston rod; a cam follower mounted on a distal end of said piston rod and pressed against said torque compensation plate cam, the torque compensation plate cam having a caming contour so that said torque compensation plate cam in conjunction with said resilient force-producing device cancels the load fluctuating torque during the entire rotation of the crankshaft.

17. The method according to claim 16, in which said resilient force-producing device comprises a cylinder slidably receiving said piston rod therein, and a compression coil spring mounted within said cylinder to urge said piston rod.

18. The method according to claim 17, in which said crankshaft is of the dual type, and two connecting rods are connected to said slider.

19. The method according to claim 16, in which said resilient force-producing device comprises a cylinder slidably receiving said piston rod therein, and gas being sealed within said cylinder to urge said piston rod.

20. The method according to claim 19, in which said crankshaft is of the dual type, and two connecting rods are connected to said slider.

21. The method according to claim 16, wherein a negative inertia torque is produced when the slider moves from the center of its reciprocal stroke to the ends of its stroke and a positive inertia torque is produced when said slider moves from the ends of its stroke to the center of its reciprocal stroke.

22. The method according to claim 16, wherein the inertia torque acts on said crankshaft during the reciprocal linear stroke motion of said slider, and an opposite torque is produced by the torque compensation plate cam in conjunction with the resilient force-producing device; the caming contour of the torque compensation plate cam shaped so that the sum of the inertia torque and opposite torque is zero and the load fluctuation torque of the crankshaft produced during the rotation of the crankshaft is cancelled.

* * * * *